US008840043B2

(12) United States Patent
Nakazono et al.

(10) Patent No.: US 8,840,043 B2
(45) Date of Patent: Sep. 23, 2014

(54) ROTARY ATOMIZATION COATING DEVICE

(75) Inventors: Daisuke Nakazono, Tochigi (JP); Junichi Fukuno, Tochigi (JP); Masayuki Yamaguchi, Tochigi (JP); Yusuke Nakajima, Tokyo (JP)

(73) Assignee: Honda Motor Co., Ltd., Tokyo (JP)

( * ) Notice: Subject to any disclaimer, the term of this patent is extended or adjusted under 35 U.S.C. 154(b) by 492 days.

(21) Appl. No.: 13/344,320

(22) Filed: Jan. 5, 2012

(65) Prior Publication Data

US 2012/0193453 A1 Aug. 2, 2012

(30) Foreign Application Priority Data

Jan. 27, 2011 (JP) ..... 2011-014694

(51) Int. Cl.

| | |
|---|---|
| ***B05B 3/00*** | (2006.01) |
| ***B05B 5/04*** | (2006.01) |
| ***B05B 3/10*** | (2006.01) |
| ***B05B 15/02*** | (2006.01) |

(52) U.S. Cl.

CPC ..... *B05B 15/0258* (2013.01); *B05B 5/0426* (2013.01); *B05B 5/0407* (2013.01); *B05B 3/1092* (2013.01); *B05B 3/1014* (2013.01)

USPC ..... 239/243; 239/225.1

(58) Field of Classification Search

CPC ..... B05B 3/1014; B05B 3/1021

USPC ..... 239/494, 461, 463, 223, 224, 225.1, 239/243, 240

See application file for complete search history.

(56) References Cited

U.S. PATENT DOCUMENTS

| | | | | |
|---|---|---|---|---|
| 4,684,064 | A * | 8/1987 | Kwok | 239/223 |
| 6,053,437 | A * | 4/2000 | Hansinger et al. | 239/703 |
| 7,080,794 | B2 * | 7/2006 | Baumann et al. | 239/223 |
| 7,721,976 | B2 * | 5/2010 | Nolte et al. | 239/224 |
| 2010/0206962 | A1 * | 8/2010 | Nolte et al. | 239/223 |

FOREIGN PATENT DOCUMENTS

| | | | |
|---|---|---|---|
| DE | 20 2009 004 682 | U1 | 10/2009 |
| JP | 7-213991 | A | 8/1995 |

OTHER PUBLICATIONS

Chinese Office Action; Chinese Patent Application No. 2013122001181420 dated Dec. 25, 2013.

* cited by examiner

*Primary Examiner* — Davis Hwu
(74) *Attorney, Agent, or Firm* — Rankin, Hill & Clark LLP

(57) ABSTRACT

A rotary atomization coating device is provided with a rotary atomizing head including a paint storage and adapted to atomize paint supplied to the paint storage and to discharge the paint onto a work, and a paint supplying nozzle adapted to supply the paint to the paint storage. The rotary atomizing head includes a plurality of bell cups. Each of the bell cups includes, at a front face thereof, a paint discharging face adapted to thin the paint by a centrifugal force. The rotary atomizing head includes a plurality of paint supplying holes corresponding to the respective bell cups. The paint supplying holes are adapted to supply the paint from the paint storage to the respective paint discharging faces. A plurality of grooves extending along a radial direction of the rotary atomizing head are formed at circumferential portions of the respective paint discharging faces.

7 Claims, 4 Drawing Sheets

ROTARY ATOMIZATION COATING DEVICE

BACKGROUND OF THE INVENTION

1. Field of the Invention

The present invention relates to a rotary atomization coating device.

2. Related Art

A rotary atomization coating device has been known. By the rotary atomization coating device, a coating, for example of a body of an automobile and the like, is carried out. In the rotary atomization coating device, a high voltage is applied to a rotary atomizing head which is rotating, and a conductive paint (liquid paint) is supplied to the rotating rotary atomizing head to which the high voltage is applied. Thereby, electrified and atomized paint is sprayed from a front end edge of the rotary atomizing head, and an electrostatic coating is performed.

According to the rotary atomizing coating device disclosed in JP-A-07-213991, the paint supplied to the rotary atomizing head through axial holes is led along an inner surface (paint discharging face) of the rotary atomizing head to a discharging end edge as a liquid film. The led paint is subdivided into a number of liquid threads through grooves formed at the discharging end edge to thereby be discharged.

Recently, in order to reduce the number of coating robots, it is required to increase a discharging amount of paint per one rotary atomizing head. If the amount of paint supplied to the rotary atomizing head is increased in the conventional system to meet such requirement, a thickness of the liquid film on a surface of the rotary atomizing head becomes thick, thereby the liquid film flows on the surface of the rotary atomizing head in a state where a sufficient centrifugal force is not provided. In this case, the thick portion of the liquid film flows in a circumferential direction with respect to the rotary atomizing head due to the Coriolis Effect thereby causing the thickness of the liquid film to become thicker. Accordingly, the atomization efficiency is worsened thereby causing a problem in the quality of coating film. To solve such problem, increasing the size of the rotary atomizing head may be considered, but this is not a preferable measure due to a relationship with inner parts and the like of a vehicle or a reduction in the number of revolution caused by an increase in a weight of the rotary atomizing head or the like.

SUMMARY OF THE INVENTION

One or more embodiments of the invention relate to a rotary atomization coating device capable of enhancing a atomization efficiency of paint.

DETAILED DESCRIPTION OF THE EMBODIMENTS

Hereinafter, the rotary atomization coating device according to exemplary embodiments of the present invention Will now be described with reference to the accompanying drawings. Note that, the embodiments described herein are not intended to limit the invention but only to exemplify the invention, and all features or combinations of the features of the embodiments are not always essential to the invention.

Figure 1:
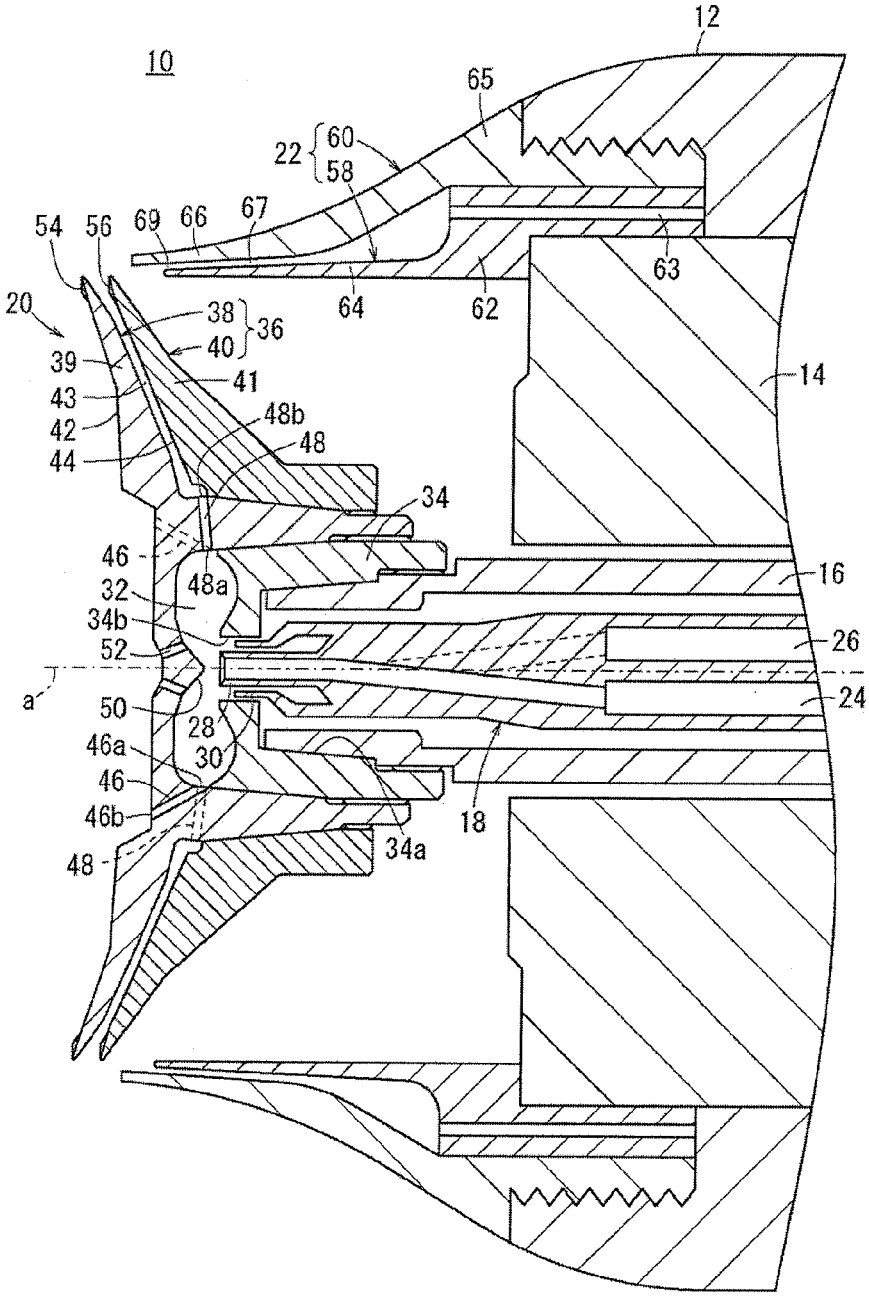
FIG. 1 is a longitudinal sectional view showing a rotary atomization coating device according to an embodiment of the present invention.

FIG. 1 is a longitudinal sectional view showing a rotary atomization coating device 10 according to an exemplary embodiment of the present invention. As shown in FIG. 1, the rotary atomization coating device 10 includes a casing 12 of the device, an air motor 14 installed in the casing 12, a rotational shaft 16 rotating at high speed by the air motor 14, a conduit 18 insertion-penetrating into a hollow portion of the rotational shaft 16, a bell shaped rotary atomizing head 20 installed at a front end of the rotational shaft 16, and a shaping air ring 22 jetting shaping air toward an outer peripheral edge of the front end the rotary atomizing head 20.

The air motor 14 is supplied with compressed air from a compressed air supplier not shown to thereby rotate the rotational shaft 16 at high speed. The rotational shaft 16 is connected to a high voltage generator (not shown) for generating a high-voltage. Accordingly, the bell cup is applied with a highly negative voltage through the rotational shaft 16. Also, the rotational shaft 16 is a hollow cylindrical member and the conduit 18 is disposed in the hollow portion thereof.

The conduit 18 is formed therein with a paint supplying channel 24 for supplying paint and a cleaning solution supplying channel 26 for supplying a cleaning solution. A front end portion of the conduit 18 is formed in a dual pipe shape, and a paint supplying nozzle 28 for discharging paint and a cleaning solution supplying nozzle 30 for discharging cleaning solution are formed in a coaxial shape.

The rotary atomizing head 20 is fixed to the front end of the rotational shaft 16. When the rotational shaft 16 rotates during the operation of the air motor 14, the rotary atomizing head 20 also rotates integrally together with the rotational shaft 16. The rotary atomizing head 20 is formed therein with a paint storage 32 for temporally storing paint supplied through the conduit 18. The paint storage 32 is a circle shaped space. The paint supplying nozzle 28 directs towards a centric portion of the paint storage 32.

As shown in FIG. 1, the rotary atomizing head 20 is formed of an inner member 34 fixed to the rotational shaft 16 and an outer member 36 fixed to an outer peripheral portion of the inner member 34. The paint storage 32 is formed between the inner member 34 and the outer member 36. The inner member 34 is formed therein with a concave member 34*a* into which a front end portion of the rotational shaft 16 is fitted. The inner member 34 is formed at a front centric portion thereof with an opening 34*b* into which a front end portion of the conduit 18 insertion-penetrates.

The outer member 36 has a plurality of bell cups (two in the exemplary embodiment, hereinafter, referred to as "first bell cup 38", "second bell cup 40"). The first bell cup 38 and second bell cup 40 each are formed in a circular cup shape as a whole and have flare members 39, 41 which are gradually enlarged outwards in a radial direction and towards its front direction. A ring shaped gap 43 is formed between a rear face of the flare member 39 of the first bell cup 38 and a front face of the flare member 41 of the second bell cup 40.

According to the exemplary embodiment, the outer diameter of the first bell cup 38 and the outer diameter of the second bell cup 40 are set equally. The first bell cup 38 is formed at a front face thereof with a first paint discharging face 42 thinning paint supplied to the front face, and the second bell cup 40 is formed at a front face thereof with a second paint discharging face 44 thinning paint supplied to the front face. The first paint discharging face 42 and second paint discharging face 44 both are inclined in a front direction and outwards in a radial direction. The faces 42, 44 are doughnut-shaped when viewed from its front side, and serve to thin paint from the paint storage 32 due to the centrifugal force resulting from the rotation of the first bell cup 38 and second bell cup 40.

Figure 2:
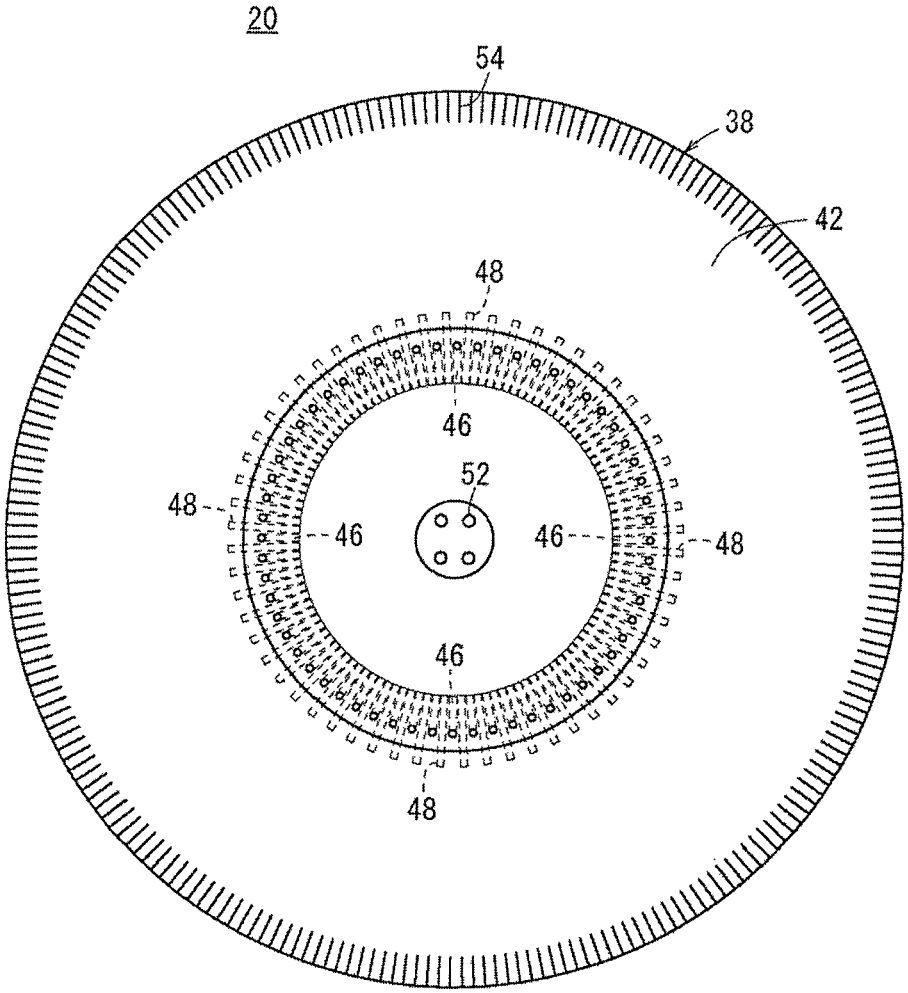
FIG. 2 is a front view showing the rotary atomization coating device shown in FIG. 1.
Figure 3:
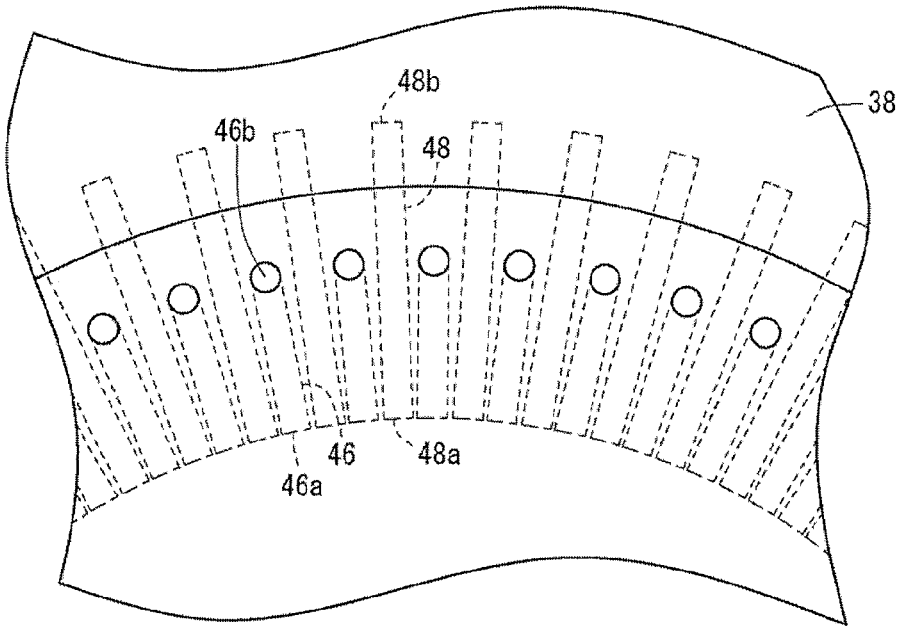
FIG. 3 is an enlarged front view of a first bell cup.

FIG. 2 is a front view showing the rotary atomizing head 20. FIG. 3 is a partly enlarged view of FIG. 2. As shown in FIGS. 1 to 3, the rotary atomizing head 20 is provided in a circumferential direction thereof with a plurality of paint supplying holes 46, 48 for supplying paint to the first and second paint discharging faces 42, 44, correspondingly to each of the first and second paint discharging faces 42, 44. Hereinafter, the paint supplying hole 46 for supplying paint to the first paint discharging face 42 is referred to as "first paint supplying hole 46" and the paint supplying hole 48 for supplying paint to the second paint discharging face 44 is referred to as "second paint supplying hole 48". In the exemplified structure shown in the drawings, the first and second paint supplying holes 46, 48 are formed in the first bell cup 38.

The plurality of first paint supplying holes 46 (sixty in the exemplified structure) are formed at equal interval along the circumferential direction in the rotary atomizing head 20 with an axial line "a" centered on the rotary atomizing head 20. As shown in FIG. 3, the first paint supplying hole 46 is opened at its one end (inner side end) as an inlet 46*a* in the paint storage 32, and opened at its other end (outer side end) as an outlet 46*b* in the front face of the first bell cup 38. Each of the first paint supplying holes 46 is extended in a radial direction of the rotary atomizing head 20 and inclined in far direction from the axial line "a" towards the front of the rotary atomizing head 20, when viewed from its front side.

The plurality of second paint supplying holes 48 (sixty, the same number as that of the first paint supplying holes 46 in the exemplified structure) are formed at equal interval along the circumferential direction in the rotary atomizing head 20 with an axial line "a" centered on the rotary atomizing head 20. As shown in FIG. 3, the first paint supplying hole 48 is opened at its one end (inner side end) as an inlet 48*a* in the paint storage 32, and opened at its other end (outer side end) as an outlet 48*b* in the outer peripheral face of the second bell cup 40.

Each of the first paint supplying holes 46 is extended in a radial direction of the rotary atomizing head 20 and inclined in far direction from the axial line "a" towards the front of the rotary atomizing head 20, when viewed from its front side. Incidentally, each of the second paint supplying holes 48 may be extended in a vertical direction with respect to the axial line "a" of the rotary atomizing head 20, in response to various conditions such as the shape and the like of the first bell cup 38 or the second bell cup 40, or may be inclined so as to near the axial line "a" of the rotary atomizing head 20 towards the rear of the rotary atomizing head 20.

The first and second paint supplying holes 46, 48 are configured to supply the same amount of paint to the first and second paint discharging faces 42, 44, respectively. That is, the first and second paint supplying holes 46, 48 are arranged at equal interval in a staggered fashion and the inlets 46*a*, 48*a* thereof are disposed on a same circumference. Accordingly, the distance between the axial line "a" of the rotary atomizing head 20 and the inlet 46*a* of the first paint supplying hole 46 is identical to the distance between the axial line "a" and the inlet 48*a* of the second paint supplying hole 48. Also, the first paint supplying hole 46 and the second paint supplying hole 48 is set to be identical to each other in the diameter and length of opening. The number of the first paint supplying hole 46 and the second paint supplying hole 48 is not limited to those of the exemplified structure shown in the drawings, but may be changed according to design conditions and the like.

The first bell cup 38 is formed at a central portion of the rear side thereof with a guide member 50 protruding towards an inner side (the conduit 18 side) of the paint storage 32, thereby distributing the supplied paint or cleaning solution to the outer side thereof in a radial direction. Also, a plurality of cleaning solution discharging holes 52 (four in the exemplified drawings) are formed around the guide member 50. The cleaning solution discharging hole 52 is inclined to intersect with the axial line "a" of the rotary atomizing head 20 at the front of the axial line thereof.

The plurality of grooves 54, 56 for jetting paint as liquid threads are arranged at equal interval in a circumferential direction on each of the front side circumferential edge portions of the first and second bell cups 38, 40 (i.e., the circumferential edge portion of the first and second paint discharging face 42, 44). Hereinafter, the groove 54 formed on the circumferential edge portion of the first paint discharging face 42 is referred to as "first groove 54" and the groove 56 formed on the circumferential edge portion of the second paint discharging face 44 is referred to as "first groove 56".

Each of the first grooves 54 and each of the second grooves 56 are provided at equal interval throughout the circumferential edge portions of the first and second paint discharging faces 42, 44, at the same time, extended along the radial direction of the rotary atomizing head 20, and serve to subdivide a thin film shaped paint flowing towards the outer side thereof in a radial direction along the first and second paint discharging faces 42, 44. Thereby, thin thread shaped paint (liquid thread) is discharged from the circumferential end portions of the first and second bell cups 38, 40.

According to the exemplary embodiment, the first groove 54 and the second groove 56 are identical to each other in its number, length and shape, but different from each other in its phase along a circumferential direction. For this reason, the liquid thread discharged from the first groove 54 and the liquid thread discharged from the second groove 56 are crossed in its phase in a circumferential direction.

The shaping air ring 22 is fixed to the front end portion of the casing 12 to surround a base portion of the rotary atomizing head 20, and serves to jet the shaping air towards the circumferential portion of the front end of the rotary atomizing head 20 direction. As shown in FIG. 1, the shaping air ring 22 is formed of an inner ring member 58 forming its inner side portion and an outer ring member 60 positioned at the outside thereof.

The inner ring member 58 is provided with a large diameter member 62 of rear end side and a small diameter member 64 provided at a front end portion of the large diameter member 62. The large diameter member 62 is formed therein with an air supplying channel 63 communicated with an air source not shown. The outer ring member 60 is provided with a large diameter member 65 being in contact at its outside with the large diameter member 62 of the inner ring member 58 of rear end side thereof and a taper portion 66 inclined in an inner direction towards the front end of the small diameter member 64 of the inner ring member 58 from the front end of the large diameter member 65.

An annular gap 67 communicated with an air supplying channel 63 is formed between the inner ring member 58 and the outer ring member 60. The front end of the gap 67 is opened as an air jet opening towards the circumferential edge of the front end of the rotary atomizing head 20, at a rear side of the circumferential end portion of the second bell cup 40. Accordingly, when air is supplied to the air supplying channel 63 from an air source not shown, shaping air is jetted from its jet opening towards the circumferential portion of the front end of the rotary atomizing head 20 and atomized paint being discharged in an outer circumferential direction from the rotary atomizing head 20 is molded in a predetermined coating pattern.

During painting, the rotational shaft 16 is rotated by the air motor 14. And, paint is discharged towards the paint storage 32 of the rotary atomizing head 20 from the paint supplying nozzle 28. Thereby, the paint having flowed into the paint storage 32 flows into the first paint supplying hole 46 and second paint supplying hole 48. In this case, the paint passing through the first paint supplying hole 46 is discharged onto the first paint discharging face 42 and thinned thereon, and thereafter, subdivided in the first groove 54 to be discharged as liquid threads from the circumferential end of the first bell cup 38. The paint having passed through the second paint supplying hole 48 is discharged onto the second paint discharging face 44 and thinned thereon, and thereafter, subdivided in the second groove 56 to be discharged as liquid threads from the circumferential end of the first bell cup 40. The liquid threads discharged from the circumferential ends of the first and second bell cups 38, 40 are atomized as paint particles.

At this time, since a high voltage is applied between the rotary atomizing head 20 and works (objects to be painted), the electrified paint particles having been atomized by the rotary atomizing head 20 fly towards the works to coat the works. Also, the sprayed pattern of the paint at this time is pattern-molded by shaping air being jetted from the shaping air ring 22.

In such a manner, according to the rotary atomization coating device 10 of the exemplary embodiment, the paint supplied from the paint supplying nozzle 28 is supplied to each of the first and second bell cups 38, 40. In each of the bell cups 38, 40, since paint is subdivided in the first and second grooves 54, 56 formed at the circumferential end portions of the first and second paint discharging faces 42, 44 to be discharged as liquid threads, the atomization efficiency of paint may be enhanced. Accordingly, even in a case where the supplied amount of paint to the rotary atomizing head 20 is increased, the paint may accurately be atomized and a superior coating film may be obtained.

Also, according to the rotary atomization coating device 10 of the exemplary embodiment, the first and second paint supplying holes 46, 48 are arranged at equal interval in a staggered fashion. Also, since their inlets 46*a*, 48*a* are disposed on a same circumference, an equal amount of paint may be supplied to the first and second bell cups 38, 40. That is, the inlet 46*a* of the first paint supplying hole 46 and the inlet 48*a* of the second paint supplying hole 48 are disposed on a same circumference and the centrifugal force is thereby equally applied to the paint at each of the inlets 46*a*, 48*a*, so that the paint is equally distributed to the first and second paint supplying holes 46, 48.

Also, according to the rotary atomization coating device 10 of the exemplary embodiment, since the first and second paint supplying holes 46, 48 are set to be identical to each other in the number of holes and the diameter of opening, an equal amount of paint may further accurately be supplied to the first and second bell cups 38, 40.

Also, according to the rotary atomization coating device 10, since the first and second bell cups 38, 40 are disposed coaxially with respect to the paint supplying nozzle 28 and have a same outer diameter, the first groove 54 provided in the first bell cup 38 and the second groove 56 provided in the second bell cup 40 may be formed in a same size and shape. Thereby, the atomization of paint in the first and second bell cups 38, 40 may evenly be realized and the grain size of paint may be equalized on the whole throughout the rotary atomizing head 20, thereby enhancing the quality of coating film.

According to the rotary atomization coating device 10 of the exemplary embodiment, since the first and second grooves 54, 56 are different from each other in its phase in a circumferential direction, the liquid threads are discharged in a crossed direction from each other at a point of time of being discharged from the circumferential portions of the first and second bell cups 38, 40, thereby evenly receiving shaping air. Accordingly, the paint may definitely be atomized (droplet) in each of the first and second bell cups 38, 40 and the quality of coating film may further be enhanced.

Also, according to the rotary atomization coating device 10 of the exemplary embodiment, since the first and second bell cups 38, 40 are fixed to each other, they rotate integrally. Accordingly, since the first and second bell cups 38, 40 all rotate with the same number of revolution, the equal centrifugal force may act on the paint supplied to the first and second bell cups 38, 40 and thus the paint may equally be atomized, thereby furthermore enhancing the quality of coating film.

In the rotary atomization coating device 10 according to the exemplary embodiment, the inlet 46*a* of the first paint supplying holes 46 and the inlet 48*a* of the second paint supplying hole 48 are disposed in the same position with respect to the direction of the axial line "a". However, the positions thereof with respect to the direction of the axial line "a" may be different from each other. Even in such construction, since the distance between the axial line "a" of the rotary atomizing head 20 and the inlet 46*a* of the first paint supplying hole 46 is equal to the distance between the axial line "a" and the inlet 48*a* of the second paint supplying hole 48, the equal amount of paint may be supplied to the first and second discharging faces 42, 44.

In the rotary atomization coating device 10, the first paint supplying hole 46 and the second paint supplying hole 48 are arranged in a staggered fashion in a circumferential direction and have separate inlets 46*a*, 48*a*. However, like the rotary atomization coating device 10*a* according to the modified example shown in FIG. 4, the inlet 70 may be shared at the first and second paint supplying holes 46, 48. That is, in the rotary atomization coating device 10*a*, the first and second paint supplying holes 46, 48 share the inlet 70 and have the inlets 46*b*, 48*b*, respectively. The first and second paint supplying holes 46, 48 coincide in its phase with reference to the circumferential direction with the axial line "a" of the rotary atomizing head 20 centered.

Figure 4:
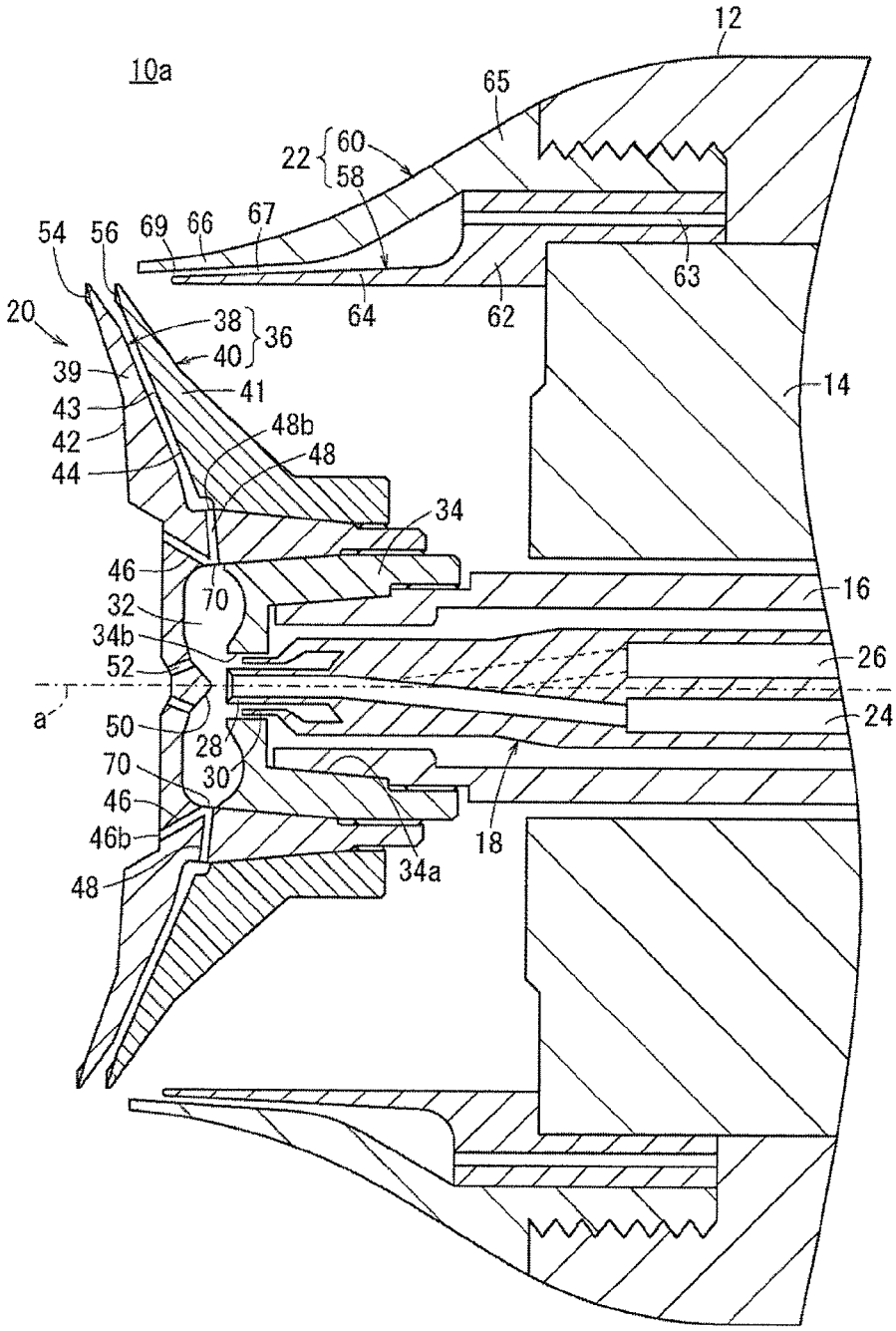
FIG. 4 is a longitudinal sectional view showing a rotary atomization coating device according to a modified embodiment of the present invention.

Even by the construction of the rotary atomization coating device 10*a* shown in FIG. 4, an equal amount of paint may be supplied to the first and second discharging faces 42, 44, likewise with the rotary atomization coating device 10 shown in FIG. 1. That is, in the rotary atomization coating device 10*a*, the first and second paint discharging faces 46, 48 share the common inlet 70 and thereby the paint supplied from the paint storage 32 is equally distributed at the inlet 70 to the first and second paint supplying holes 46, 48, so that an equal amount of paint may be supplied to the first and second paint discharging faces 42, 44.

Into the exemplary embodiment described in the foregoing, the rotary atomizing head 20 is configured to have two bell cups. However, three or more bell cups may be provided. In this case, in each of the bell cups, a paint discharging face may be formed on a front face of flare member, and each bell cup may be disposed in a staggered fashion in a direction of the axial line "a" so that an annular gap may be formed between the flare members 39, 41.

In accordance with the above embodiments, a rotary atomization coating device may include: a rotary atomizing head 20 including a paint storage 32 and adapted to atomize paint supplied to the paint storage 32 and to discharge the paint onto a work; and a paint supplying nozzle 28 adapted to supply the paint to the paint storage. The rotary atomizing head 20 may include a plurality of bell cups 38, 40. Each of the bell cups 38, 40 may include, at a front face thereof, a paint discharging face 42, 44 adapted to thin the paint by a centrifugal force. The rotary atomizing head 20 may include a plurality of paint supplying holes 46, 48 corresponding to the respective bell cups 38, 40. The paint supplying holes 46, 48 may be adapted to supply the paint from the paint storage 32 to the respective paint discharging faces 42, 44. A plurality of grooves 54, 56 extending along a radial direction of the rotary atomizing head may be formed at circumferential portions of the respective paint discharging faces 42, 44.

According to this structure, paint supplied from a paint supply nozzle is supplied to each of the plurality of bell cups, and in each of the bell cups, the paint is subdivided through grooves formed at a circumferential end portion of a paint discharging face to thereby be discharged as liquid threads thereby enhancing the atomization efficiency of paint. Accordingly, even in a case where the supplied amount of paint to the rotary atomizing head is increased, the paint can accurately be atomized and a superior coating film is thereby obtained.

In the above structure, the plurality of bell cups may include a first bell cup 38 and a second bell cup 40. The paint supplying holes 46 of the first bell cup 38 and the paint supplying holes 48 of the second bell cup 40 may be disposed at constant intervals in a staggered fashion with respect to each other. Inlets 46*a*, 48*a* of the paint supplying holes 46, 48 of the first bell cup 38 and the second bell cup 40 may be positioned on a same circumference.

According to this structure, an equal amount of paint can be supplied to each of the bell cups.

In the above structure, the number of the paint supplying holes 46, 48 and diameters of the paint supplying holes 46, 48 are identical between the plurality of bell cups 38, 40.

According to this structure, since the plurality of bell cups are identical to each other in the number of paint supplying holes and the diameter of opening, an equal amount of paint can be supplied to each of the bell cups.

In the above structure, the plurality of bell cups 38, 40 may be disposed coaxially with respect to the paint supplying nozzle 28 and have substantially the same outer diameter.

According to this structure, the diameter of the sprayed paint may be equalized on the whole by the rotary atomizing head thereby enhancing the quality of coating film.

In the above structure, phases in a circumferential direction of pitches of the plurality of grooves 54, 56 may be shifted between the plurality of bell cups 38, 40.

According to this structure, the liquid threads discharged from the circumferential portion of each of the bell cups are discharged in a staggered fashion from each other thereby equally receiving shaping air. Accordingly, the atomization (droplet) of paint in each of the bell cups can definitely be realized, as a result, the quality of coating film can furthermore be enhanced.

In the above structure, the plurality of bell cups 38, 40 may be integrally rotatable.

According to this structure, since the plurality of bell cups rotate with the same number of revolution, centrifugal force can equally be applied to the paint supplied to each bell cup thereby equally atomizing the paint. As a result, the quality of coating film may further be enhanced.

According to the rotary atomization coating device of the above embodiments, paint supplied from the paint supplying conduit is supplied to each of the plurality of bell cups, and in each bell cup the paint is atomized in grooves formed at a circumferential end portion of the paint discharging face, thereby enhancing the atomization efficiency of paint. Accordingly, even in a case where the supplied amount of paint to the rotary atomizing head is increased, the paint may definitely be atomized and a superior quality of coating film may be obtained.

The present invention has been described with reference to the embodiments. However, it will be appreciated by those skilled in the art that various modifications and changes may be made in these embodiments without departing from the sprit of the invention, the scope of which is defined in the appended claims.

What is claimed is:

1. A rotary atomization coating device, comprising:

a rotary atomizing head including a paint storage and adapted to atomize paint supplied to the paint storage and to discharge the paint onto a work; and a paint supplying nozzle adapted to supply the paint to the paint storage, wherein the rotary atomizing head includes a plurality of bell cups, wherein each of the bell cups includes, at a front face thereof, a paint discharging face adapted to thin the paint by a centrifugal force, wherein the rotary atomizing head includes a plurality of paint supplying holes corresponding to the respective bell cups, wherein the paint supplying holes are adapted to supply the paint from the paint storage to the respective paint discharging faces, and wherein a plurality of grooves extending along a radial direction of the rotary atomizing head are formed at circumferential portions of the respective paint discharging faces.

2. The rotary atomization coating device according to claim 1, wherein the plurality of bell cups includes a first bell cup and a second bell cup, wherein the paint supplying holes of the first bell cup and the paint supplying holes of the second bell cup are disposed at constant intervals in a staggered fashion with respect to each other, and wherein inlets of the paint supplying holes of the first bell cup and the second bell cup are positioned on a same circumference.

3. The rotary atomization coating device according to claim 1, wherein the number of the paint supplying holes and diameters of the paint supplying holes are identical between the plurality of bell cups.

4. The rotary atomization coating device according to claim 1, wherein the plurality of bell cups are disposed coaxially with respect to the paint supplying nozzle and have substantially the same outer diameter.

5. The rotary atomization coating device according to claim 1, wherein phases in a circumferential direction of pitches of the plurality of grooves are shifted between the plurality of bell cups.

6. The rotary atomization coating device according to claim 1, wherein the plurality of bell cups are integrally rotatable.

7. A rotary atomization coating device, comprising:

a rotary atomizing head including a paint storage and adapted to atomize paint supplied to the paint storage and to discharge the paint onto a work; and a paint supplying nozzle adapted to supply the paint to the paint storage, wherein the rotary atomizing head includes a plurality of bell cups, wherein each of the bell cups includes, at a front face thereof, a paint discharging face adapted to thin the paint by a centrifugal force, wherein the rotary atomizing head includes a plurality of paint supplying holes corresponding to the respective bell cups, wherein the paint supplying holes are adapted to supply the paint from the paint storage to the respective paint discharging faces, wherein a plurality of grooves extending along a radial direction of the rotary atomizing head are formed at circumferential portions of the respective paint discharging faces, wherein the plurality of bell cups includes a first bell cup and a second bell cup, wherein the paint supplying holes of the first bell cup and the paint supplying holes of the second bell cup are disposed at constant intervals in a staggered fashion with respect to each other, wherein inlets of the paint supplying holes of the first bell cup and the second bell cup are positioned on a same circumference, wherein the number of the paint supplying holes and diameters of the paint supplying holes are identical between the plurality of bell cups, wherein the plurality of bell cups are disposed coaxially with respect to the paint supplying nozzle and have substantially the same outer diameter, wherein phases in a circumferential direction of pitches of the plurality of grooves are shifted between the plurality of bell cups, and wherein the plurality of bell cups are integrally rotatable.

* * * * *